US011031702B2

(12) United States Patent
Chiang

(10) Patent No.: US 11,031,702 B2
(45) Date of Patent: Jun. 8, 2021

(54) PHASED ARRAY ANTENNA STRUCTURE

(71) Applicant: AUDEN TECHNO CORP., Taoyuan (TW)

(72) Inventor: Chi-Ming Chiang, Taoyuan (TW)

(73) Assignee: AUDEN TECHNO CORP., Taoyuan (TW)

( * ) Notice: Subject to any disclaimer, the term of this patent is extended or adjusted under 35 U.S.C. 154(b) by 118 days.

(21) Appl. No.: 16/508,481

(22) Filed: Jul. 11, 2019

(65) Prior Publication Data

US 2021/0013628 A1 Jan. 14, 2021

(51) Int. Cl.

| | |
|---|---|
| ***H01Q 21/22*** | (2006.01) |
| ***H01Q 9/04*** | (2006.01) |
| ***H01Q 3/38*** | (2006.01) |
| ***H01Q 25/00*** | (2006.01) |

(52) U.S. Cl.

CPC ..... *H01Q 21/22* (2013.01); *H01Q 3/38* (2013.01); *H01Q 9/04* (2013.01); *H01Q 25/00* (2013.01)

(58) Field of Classification Search

CPC ..... H01Q 21/22; H01Q 25/00; H01Q 3/38; H01Q 9/04; H01Q 21/065; H01Q 21/061; H01Q 1/38; H01Q 1/2283; H01Q 1/246; H01Q 21/24; H01Q 3/34; H01Q 3/36

See application file for complete search history.

(56) References Cited

U.S. PATENT DOCUMENTS

| | | | | |
|---|---|---|---|---|
| 2008/0079640 | A1* | 4/2008 | Yang | H01Q 21/10 343/702 |
| 2016/0197411 | A1* | 7/2016 | Subbaraman | H05K 3/125 29/600 |
| 2019/0253125 | A1* | 8/2019 | Apaydin | H01P 5/12 |
| 2019/0348768 | A1* | 11/2019 | Behdad | H01Q 19/10 |

* cited by examiner

*Primary Examiner* — Dameon E Levi

*Assistant Examiner* — David E Lotter

(74) *Attorney, Agent, or Firm* — Li & Cai Intellectual Property (USA) Office

(57) ABSTRACT

A phased array antenna structure includes a carrier, a radiative layer and a circuit layer both disposed on the carrier, and a phase switch. The radiative layer includes two radiating portions. The circuit layer includes a phased antenna and a transmission circuit. The phased antenna including two end portions respectively connected to the two radiating portions. The transmission circuit includes a feeding end and an externally connecting end that is arranged adjacent to the phased antenna. The phase switch is connected to the externally connecting end of the transmission circuit, and the phase switch is configured to selectively connect only one of the two end portions of the phased antenna.

6 Claims, 15 Drawing Sheets

PHASED ARRAY ANTENNA STRUCTURE

FIELD OF THE DISCLOSURE

The present disclosure relates to an antenna structure, and more particularly to a phased array antenna structure.

BACKGROUND OF THE DISCLOSURE

A conventional antenna structure is provided with an expensive phase shifter to satisfy different pattern requirements. In other words, the conventional antenna structure for generating different patterns has to cooperate with a phase shifter, which is an established impression in the antenna field, so that the improvement of the conventional antenna structure has been neglected.

SUMMARY OF THE DISCLOSURE

In response to the above-referenced technical inadequacies, the present disclosure provides a phased array antenna structure to effectively improve the issues associated with conventional antenna structures.

In one aspect, the present disclosure provides a phased array antenna structure, which includes a carrier, a radiative layer, a circuit layer, and N number of phase switching units. The radiative layer includes N number of radiating portions disposed on the carrier, and N is a positive integer greater than one. The circuit layer is disposed on the carrier and includes N number of phased antenna units and a transmission circuit. The N number of phased antenna units respectively correspond in position to the N numbers of the radiating portions. Each of the phase switching units includes a plurality of phased antennas spaced apart from each other and having different lengths. The transmission circuit includes a feeding end and N number of externally connecting ends. The N number of the externally connecting ends are respectively arranged adjacent to the N number of the phased antenna units. The N number of the phase switching units respectively correspond in position to the N number of the phased antenna units. The N number of phase switching units are respectively connected to the N number of the externally connecting ends of the transmission circuit, and are respectively connected to the N number of radiating portions. In each of the phased antenna units and the corresponding phase switching unit, the phase switching unit is configured to selectively connect with only one of the phased antennas, so that the phased array antenna structure is able to generate at least 2N number of antenna patterns.

In one aspect, the present disclosure provides a phased array antenna structure, which includes a carrier, a radiative layer, a circuit layer, and a phase switch. The radiative layer includes two radiating portions disposed on the carrier. The circuit layer is disposed on the carrier and includes a phased antenna and a transmission circuit. The phased antenna includes two end portions respectively connected to the two radiating portions. The transmission circuit includes a feeding end and an externally connecting end that is arranged adjacent to the phased antenna. The phase switch is connected to the externally connecting end of the transmission circuit, and the phase switch is configured to selectively connect with only one of the two end portions of the phased antenna.

Therefore, the phased array antenna structure in the present disclosure can effectively use the phase switching units (or the phase switch) by the structural design and the cooperation of the radiative layer and the circuit layer, so that phased array antenna structure of the present disclosure can be formed without the phase shifter that is at least ten times more expensive than the phase switches.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
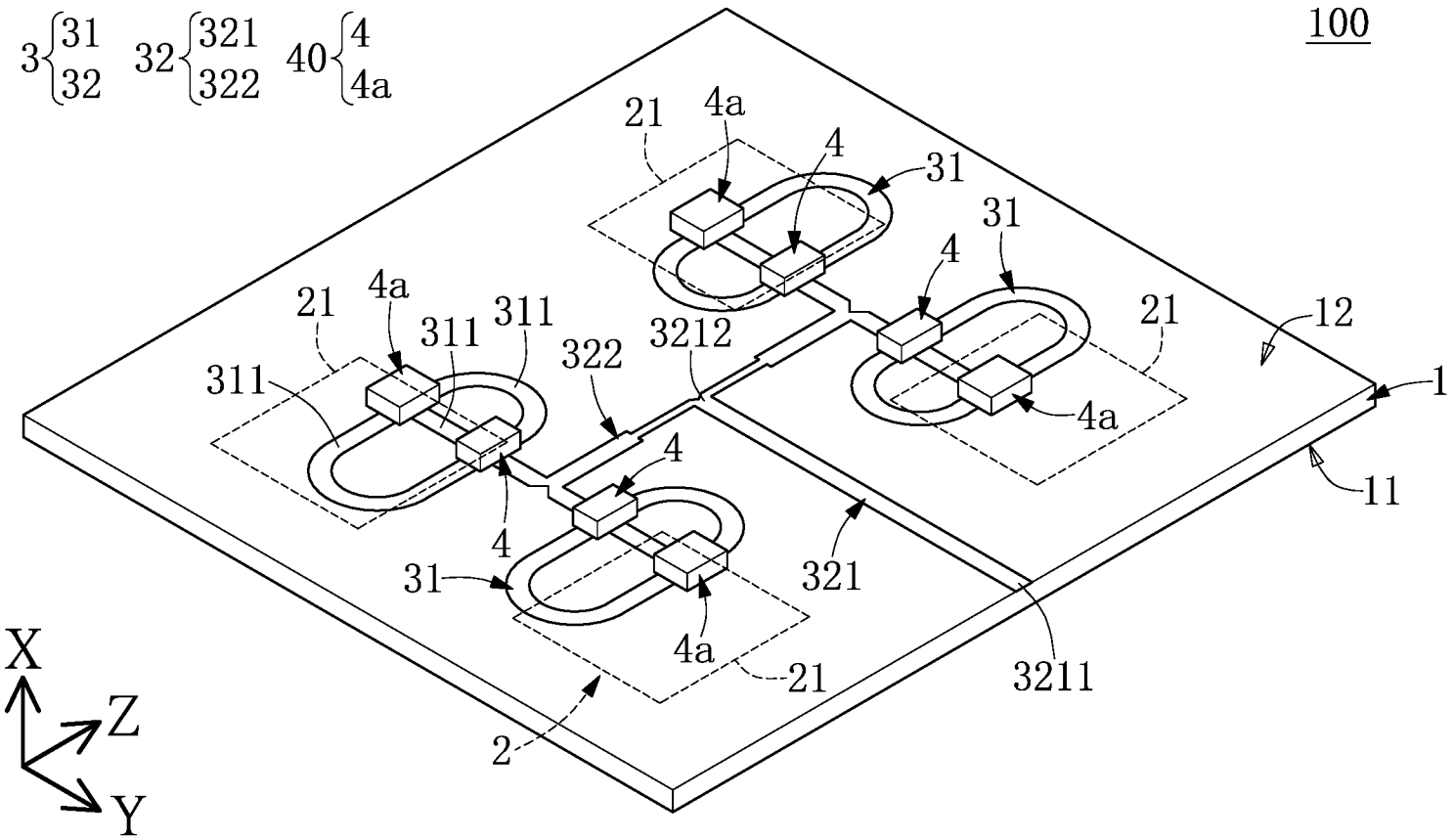
FIG. 1 is a perspective view of a phased array antenna structure according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
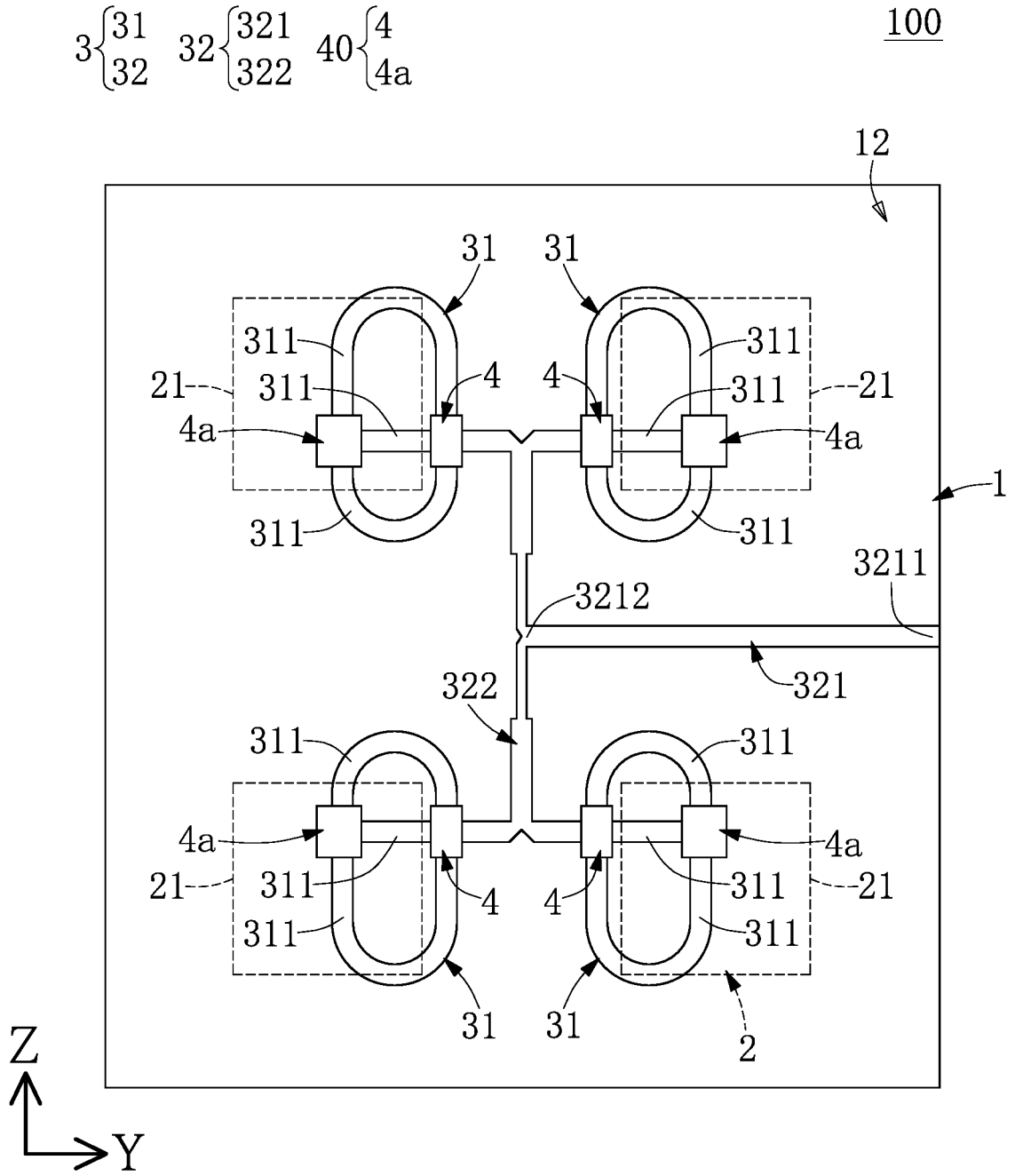
FIG. 2 is a top view of FIG. 1.
Figure 3:
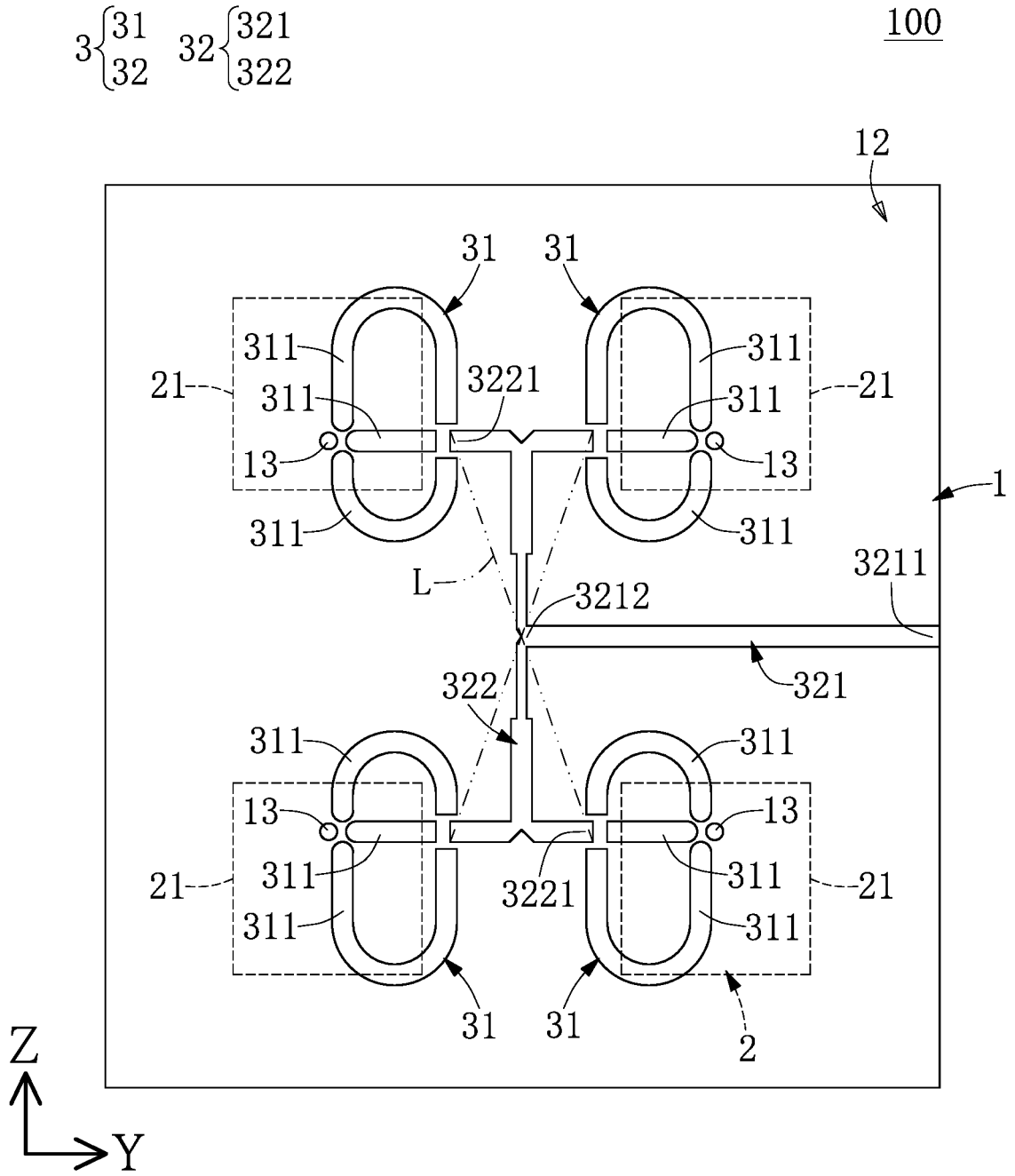
FIG. 3 is a top view of FIG. 1 with a phase switching unit omitted.
Figure 4:
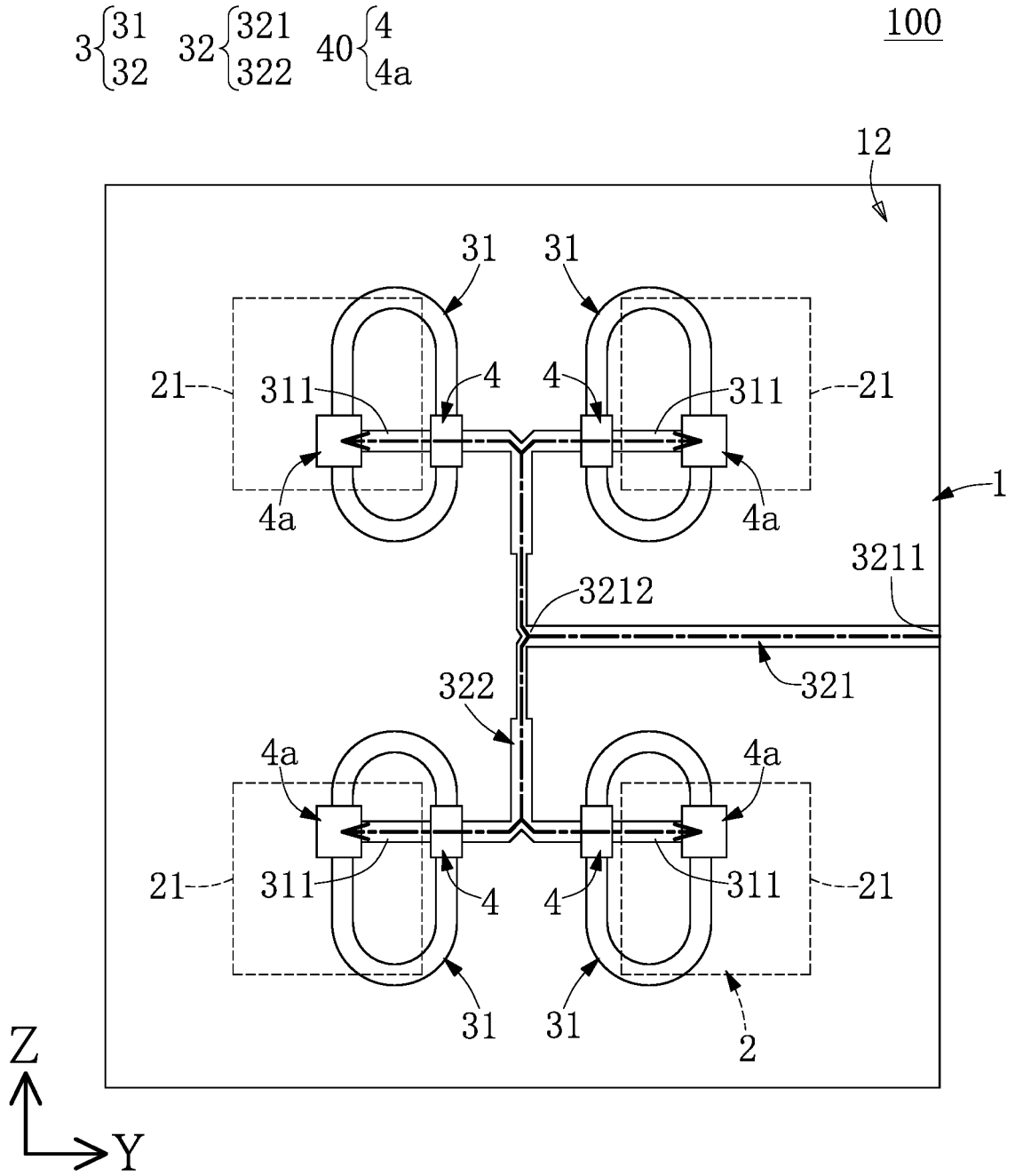
FIG. 4 is a schematic view showing a first operation mode of the phased array antenna structure according to the first embodiment of the present disclosure.
Figure 5:
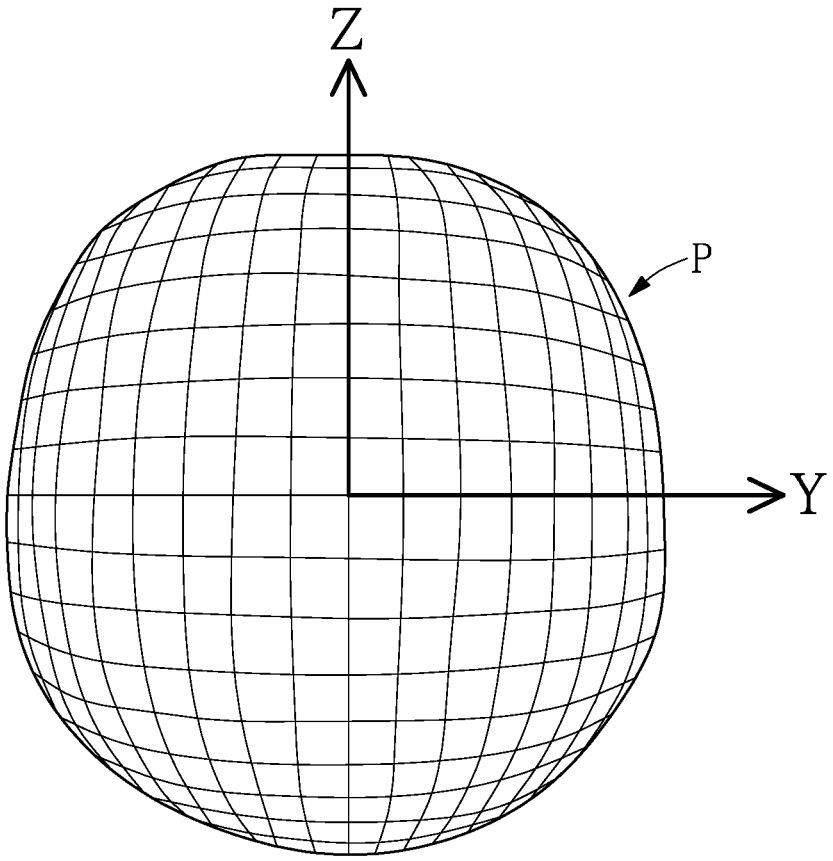
FIG. 5 is an antenna pattern view of FIG. 4.
Figure 6:
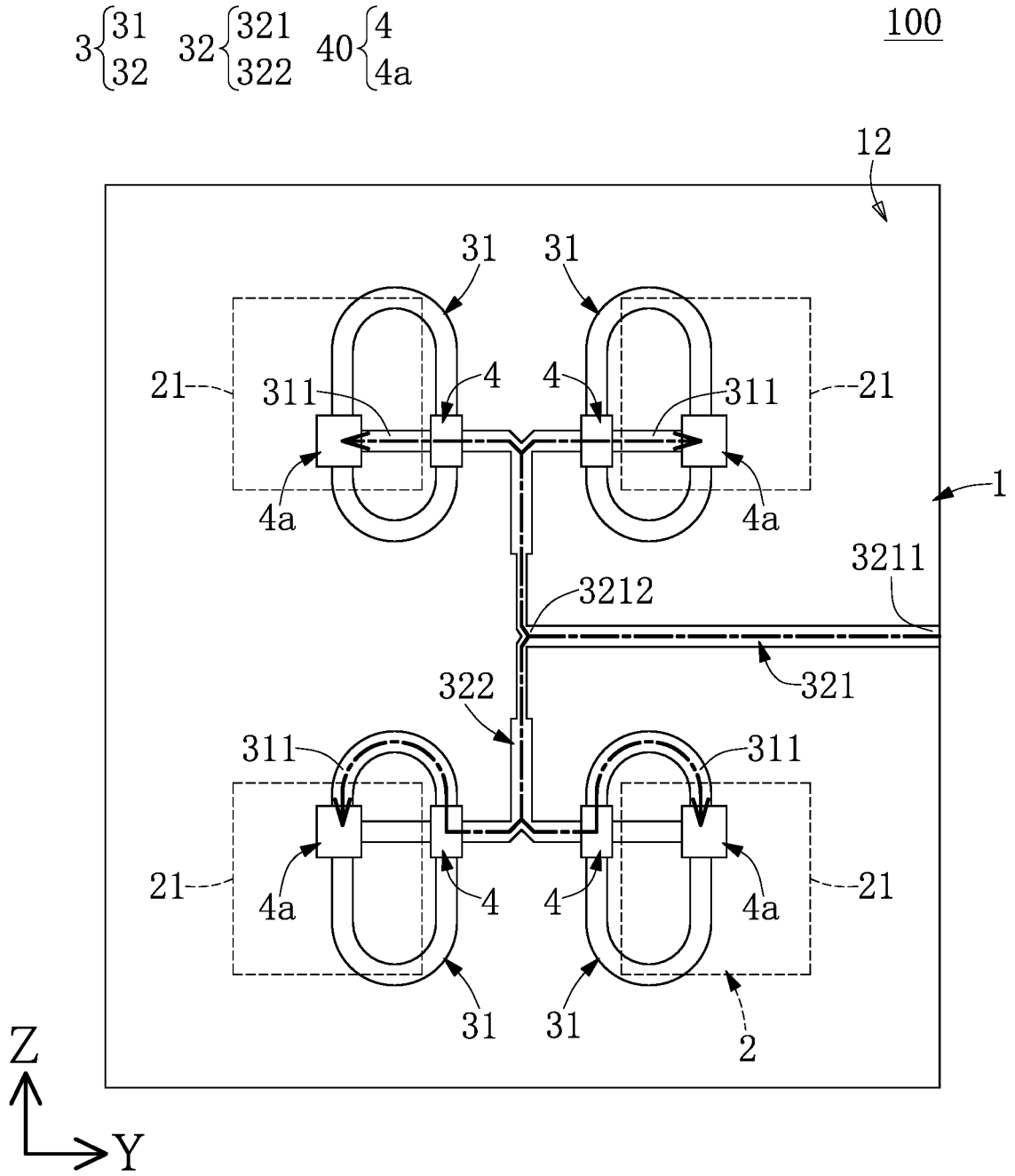
FIG. 6 is a schematic view showing a second operation mode of the phased array antenna structure according to the first embodiment of the present disclosure.
Figure 7:
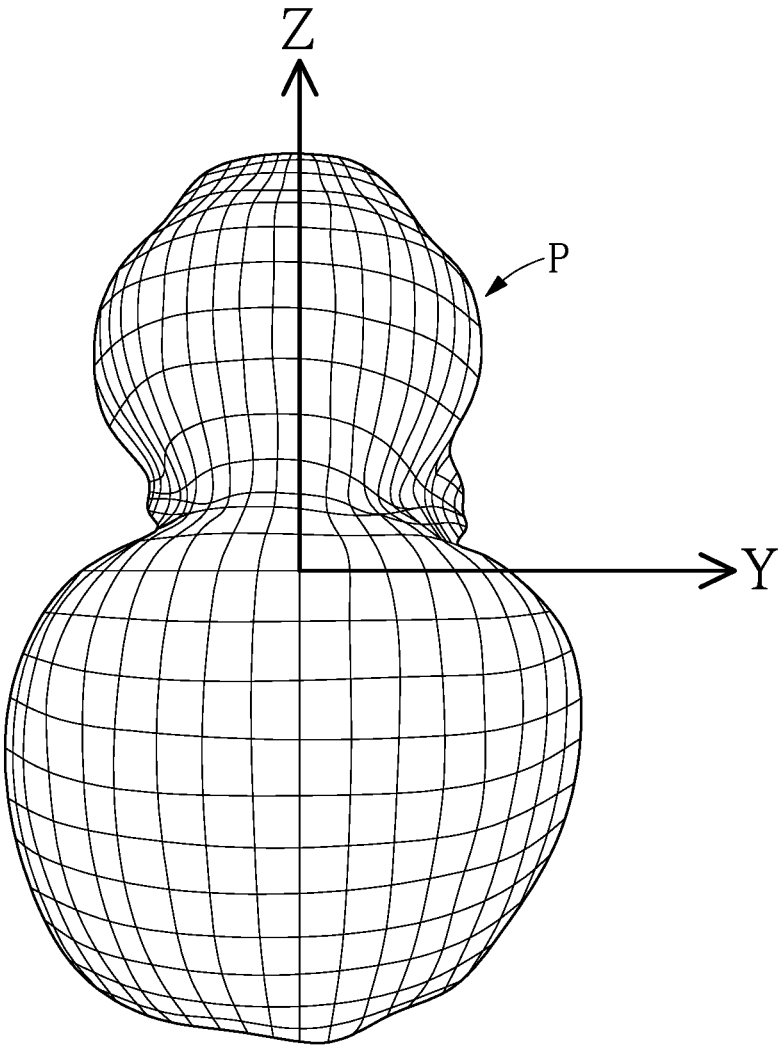
FIG. 7 is an antenna pattern view of FIG. 6.
Figure 8:
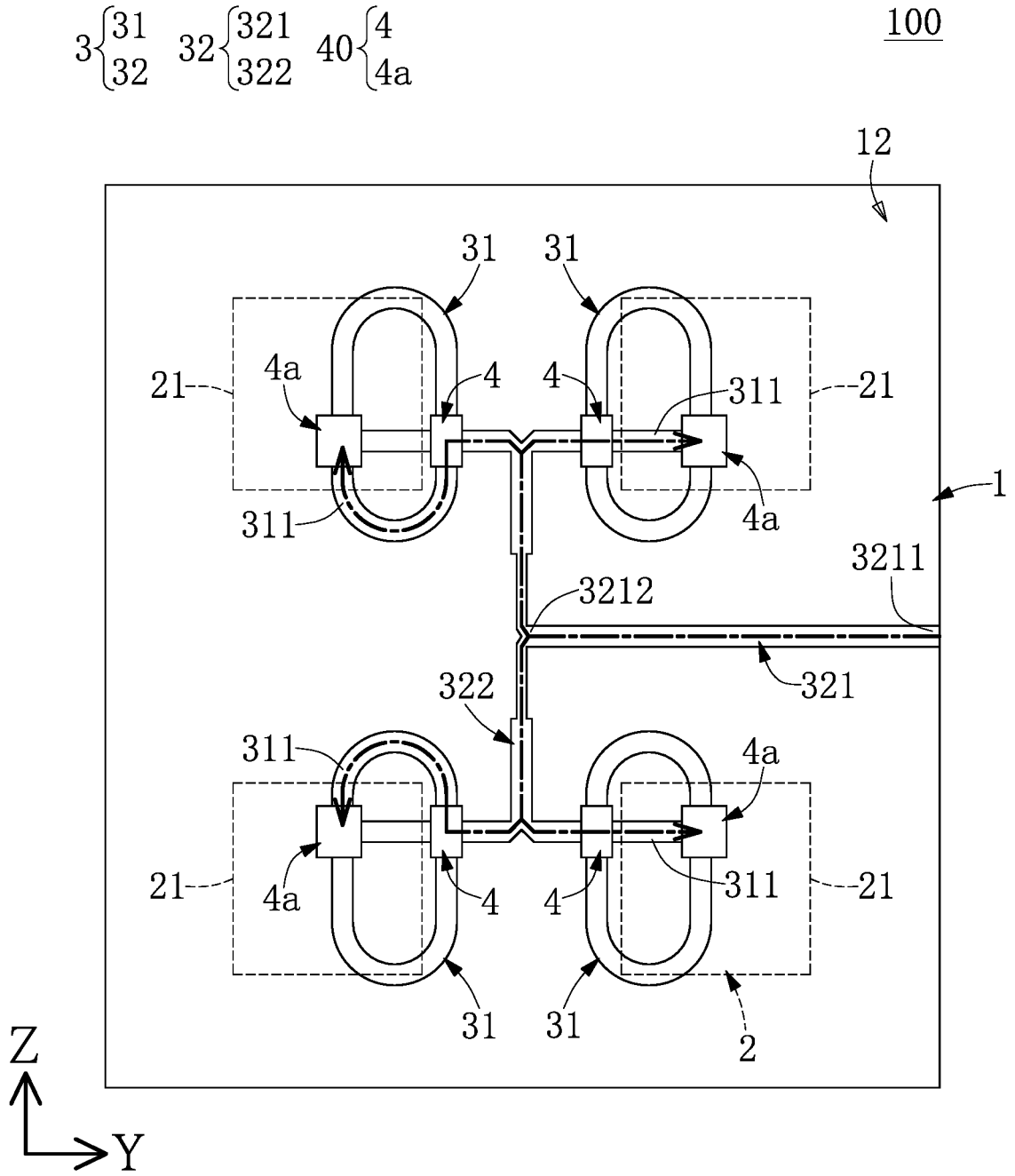
FIG. 8 is a schematic view showing a third operation mode of the phased array antenna structure according to the first embodiment of the present disclosure.
Figure 9:
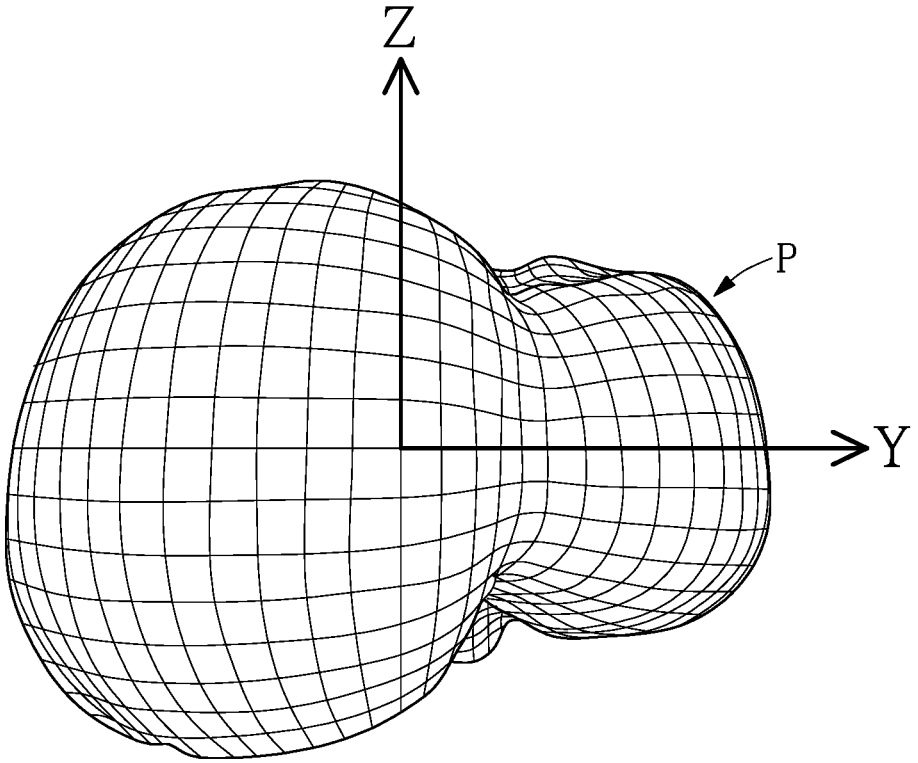
FIG. 9 is an antenna pattern view of FIG. 8.
Figure 10:
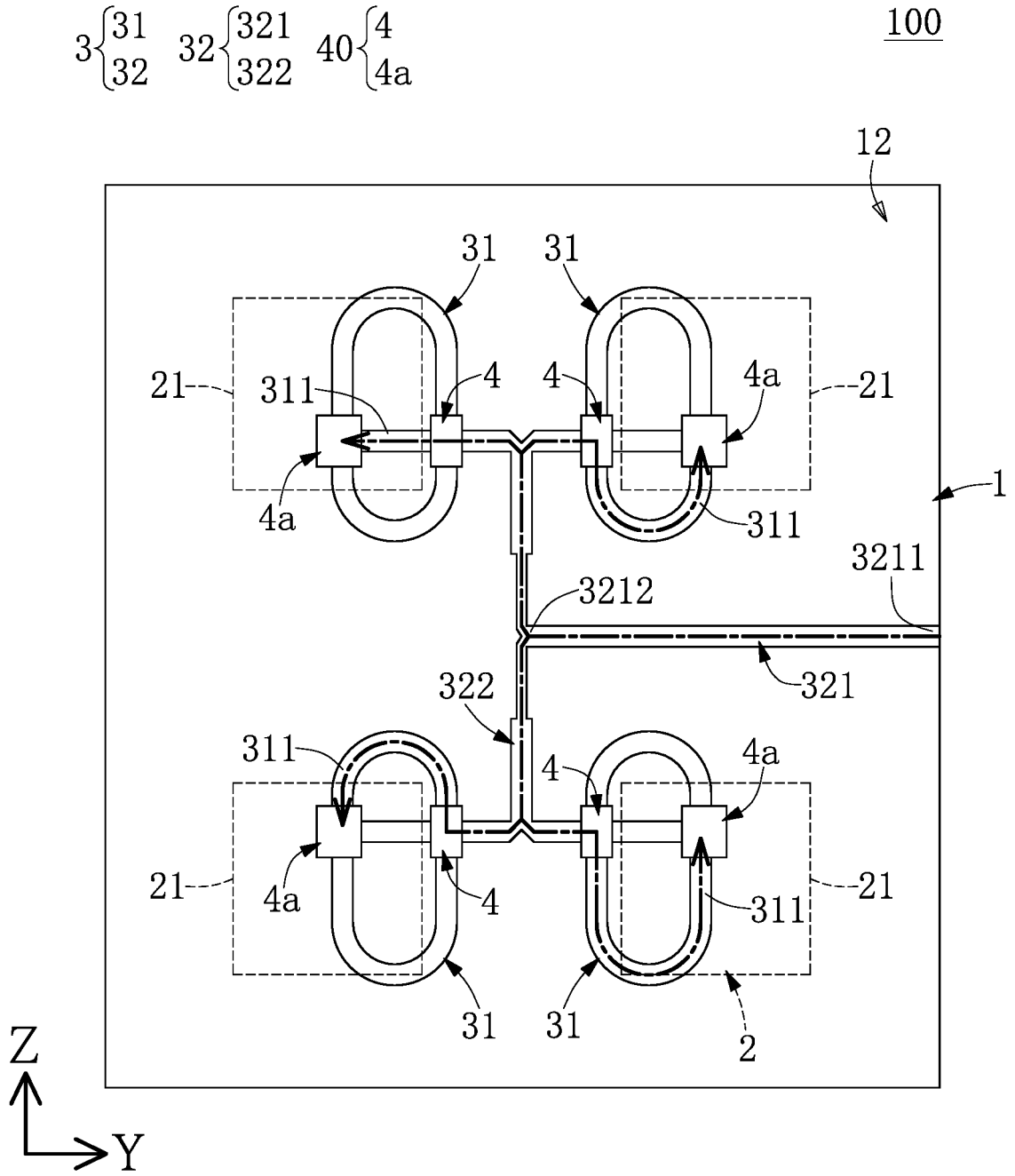
FIG. 10 is a schematic view showing a fourth operation mode of the phased array antenna structure according to the first embodiment of the present disclosure.
Figure 11:
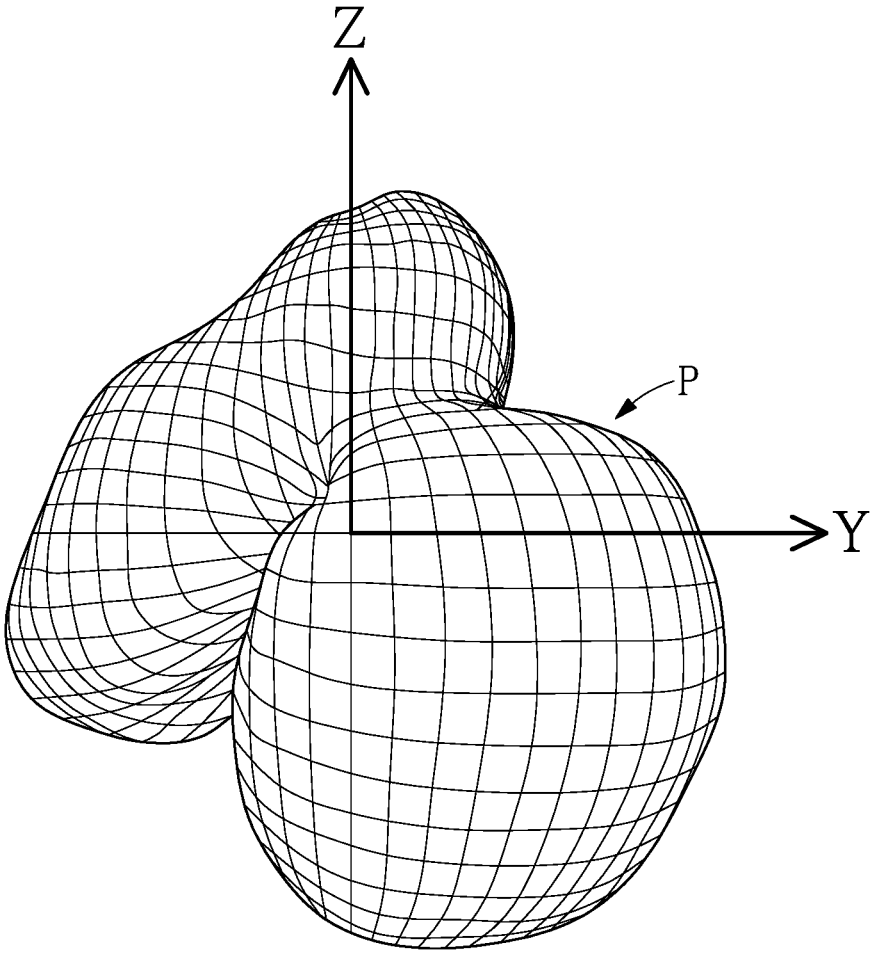
FIG. 11 is an antenna pattern view of FIG. 10.

Referring to FIG. 1 to FIG. 11, a first embodiment of the present disclosure provides a phased array antenna structure 100. Each of the drawings are provided with X axis, Y axis, and Z axis for clearly describing the present embodiment. As shown in FIG. 1 to FIG. 3, the phased array antenna structure 100 in the present embodiment is operated in a frequency band that has a center frequency corresponding to a wavelength (i.e., the center frequency is a reciprocal of the wavelength). The phased array antenna structure 100 includes a carrier 1, a radiative layer 2 and a circuit layer 3 both disposed on the carrier 1, and N number of phase switching units 40 mounted on the carrier 1 and corresponding in position to the circuit layer 3.

Specifically, "N" is a positive integer greater than one, and "N" in the present embodiment is four, but the present disclosure is not limited thereto. For example, in other embodiments of the present disclosure, "N" can be two, three, or at least five. In addition, the phased array antenna structure 100 can further include other components (e.g., a grounding layer) disposed on the carrier 1, but the related description in the present embodiment will be omitted for the sake of brevity.

As shown in FIG. 1 to FIG. 3, the carrier 1 in the present embodiment is a flat board, and includes a first surface 11 and a second surface 12 opposite to the first surface 11. The radiative layer 2 is disposed on the first surface 11 of the carrier 1, and the circuit layer 3 and the N number of the phase switching units 40 are disposed on the second surface 12 of the carrier 1, but the present disclosure is not limited thereto. For example, in other embodiments of the present disclosure, the radiative layer 2 and at least one of the circuit layer 3 and the N number of the phase switching units 40 can be disposed on the same surface of the carrier 1.

The radiative layer 2 includes N number of radiating portions 21, and the N number of the radiating portions 21 in the present embodiment have the same shape (e.g., square) and are formed on the first surface 11 of the carrier 1 in a matrix arrangement. The circuit layer 3 includes N number of phased antenna units 31 respectively corresponding in position to the number of the radiating portions 21 and a transmission circuit 32 corresponding in position to the N number of the phased antenna units 31.

Specifically, each of the phased antenna units 31 includes a plurality of phased antennas 311 spaced apart from each other and having different lengths. In the present embodiment, the carrier 1 includes a plurality of conductive posts 13, and each of the phased antennas 311 is electrically coupled to the corresponding radiating portion 21 through one of the conductive posts 13.

Moreover, the different lengths of the phased antennas 311 of each of the phased antenna units 31 are multiples of ¼ of the wavelength. In other words, the lengths of the three phased antennas 311 of each of the phased antenna units 31 shown in FIG. 3 are respectively ¼, 2/4, and ¾ of the wavelength, but the present disclosure is not limited thereto. In each of the phased antenna units 31, at least one of the phased antennas 311 has a U-shaped portion that can also be regarded as a C-shape portion.

In addition, in each of the phased antenna units 31 and the corresponding radiating portion 21, a projected region defined by orthogonally projecting the radiating portion 21 onto the second surface 12 of the carrier 1 covers at least part of the phased antenna unit 31 (or at least part of each of the phased antennas 311).

As shown in FIG. 1 to FIG. 3, the transmission circuit 32 includes a feeding circuit 321 and a branch circuit 322 connected to the feeding circuit 321. The feeding circuit 321 in the present embodiment is in a substantial straight shape and has a feeding end 3211 and a connecting end 3212. The feeding end 3211 is disposed on (or flush with) an edge of the carrier 1. The feeding circuit 321 extends from the feeding end 3211 to the connecting end 3212 (or the branch circuit 322) by passing through a region between two of the phased antenna units 31 adjacent to each other. The feeding end 3211 is configured to connect and fix to an electrical connector (not shown), thereby establishing a signal transmission path from the phased array antenna structure 100 to an external device.

The branch circuit 322 in the present embodiment is in a substantial H-shape, and includes N number of externally connecting ends 3221 respectively arranged adjacent to the N number of the phased antenna units 31. In other words, distal ends of the branch circuit 322 are the externally connecting ends 3221, and each of the externally connecting ends 3221 is spaced apart from the corresponding phased antenna unit 31.

Moreover, the connecting end 3212 of the feeding circuit 321 is connected to the branch circuit 322. The N number of the externally connecting ends 3221 define a plurality of cross lines L each connecting two of the N number of the externally connecting ends 3221, and the connecting end 3212 is substantially located at a point intersection of the cross lines L. In the present embodiment, a plurality of paths respectively defined from the N number of the externally connecting ends 3221 to the connecting end 3212 have the same distance. In other words, the connecting end 3212 of the feeding circuit 321 is connected to a central point of the branch circuit 322 for synchronous signal transmission, but the present disclosure is not limited thereto.

In other words, two of the phased antenna units 31 adjacent to the feeding end 3211 (e.g., the right two phased antenna units 31 shown in FIG. 3) and the other two of the phased antenna units 31 (e.g., the left two phased antenna units 31 shown in FIG. 3) are in a 2-fold rotational symmetry with respect to the connecting end 3212.

The N number of the phase switching units 40 respectively correspond in position to the N number of the phased antenna units 31, and each of the phase switching units 40 in the present embodiment is arranged adjacent to the corresponding phased antenna unit 31. The N number of the phase switching units 40 are respectively connected to the N number of the externally connecting ends 3221 of the transmission circuit 32, and are respectively connected to the N number of radiating portions 21. In the present embodiment, each of the phase switching units 40 includes two phase switches (4, 4*a*). In each of the phase switching units 40, one of the two phase switches 4 is connected to the corresponding externally connecting end 3221, and the other phase switch 4*a* is connected to the corresponding radiating portion 21 through one of the conductive posts 13 embedded in the carrier 1, but the present disclosure is not limited thereto. For example, in other embodiments of the present disclosure, the phase switch (4, 4*a*) can be indirectly connected to the externally connecting end 3221 or the radiating portion 21 through a cable, or the phase switching unit 40 can be a single phase switch.

Moreover, in each of the phased antenna units 31 and the corresponding phase switching unit 40, the phase switching unit 40 is configured to selectively connect only one of the phased antennas 311, so that the phased array antenna structure 100 is able to generate at least 2N number of antenna patterns P. In other words, the two phase switches (4, 4*a*) of the phase switching unit 40 are configured to selectively connect the same phased antenna 311. In addition, according to a user's requirements, each of the phase switching units 40 can be connected to the phased antennas 311 having the same length (shown in FIG. 4 and FIG. 5), or the phase switching units 40 can be connected to the phased antennas 311 having different lengths (shown in FIG. 6 to FIG. 11), so that the phased array antenna structure 100 can be used to generate a specific antenna pattern P for the user's requirements. Accordingly, since "N" is taken as four in the present embodiment, the phased array antenna structure 100 can be used to generate nine different antenna patterns P. The drawings of the present embodiment only show four of the nine different antenna patterns P.

In summary, the phased array antenna structure 100 in the present embodiment can be effectively cooperated with the phase switching units 40 by the structural design and the cooperation of the radiative layer 2 and the circuit layer 3, so that phased array antenna structure 100 of the present embodiment can be formed without the phase shifter that is at least ten times more expensive than the phase switches (4, 4*a*).

Second Embodiment

Referring to FIG. 12 to FIG. 15, a second embodiment of the present disclosure is similar to the first embodiment of the present disclosure, so that the descriptions of the same components in the first and second embodiments of the present disclosure will be omitted for the sake of brevity, and the following description only discloses different features between the first and second embodiments.

Figure 12:
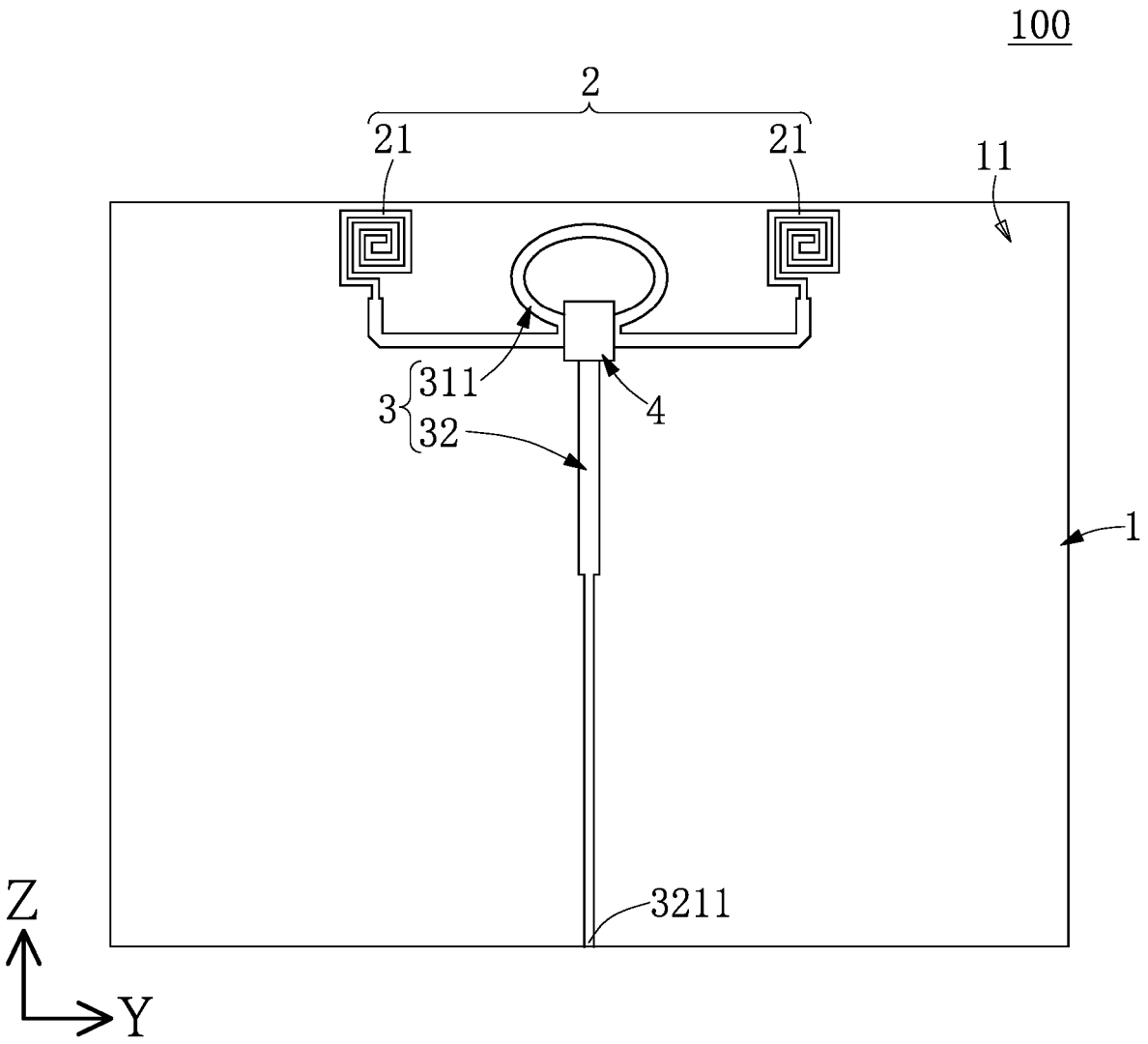
FIG. 12 is a planar view of a phased array antenna structure according to a second embodiment of the present disclosure.
Figure 13:
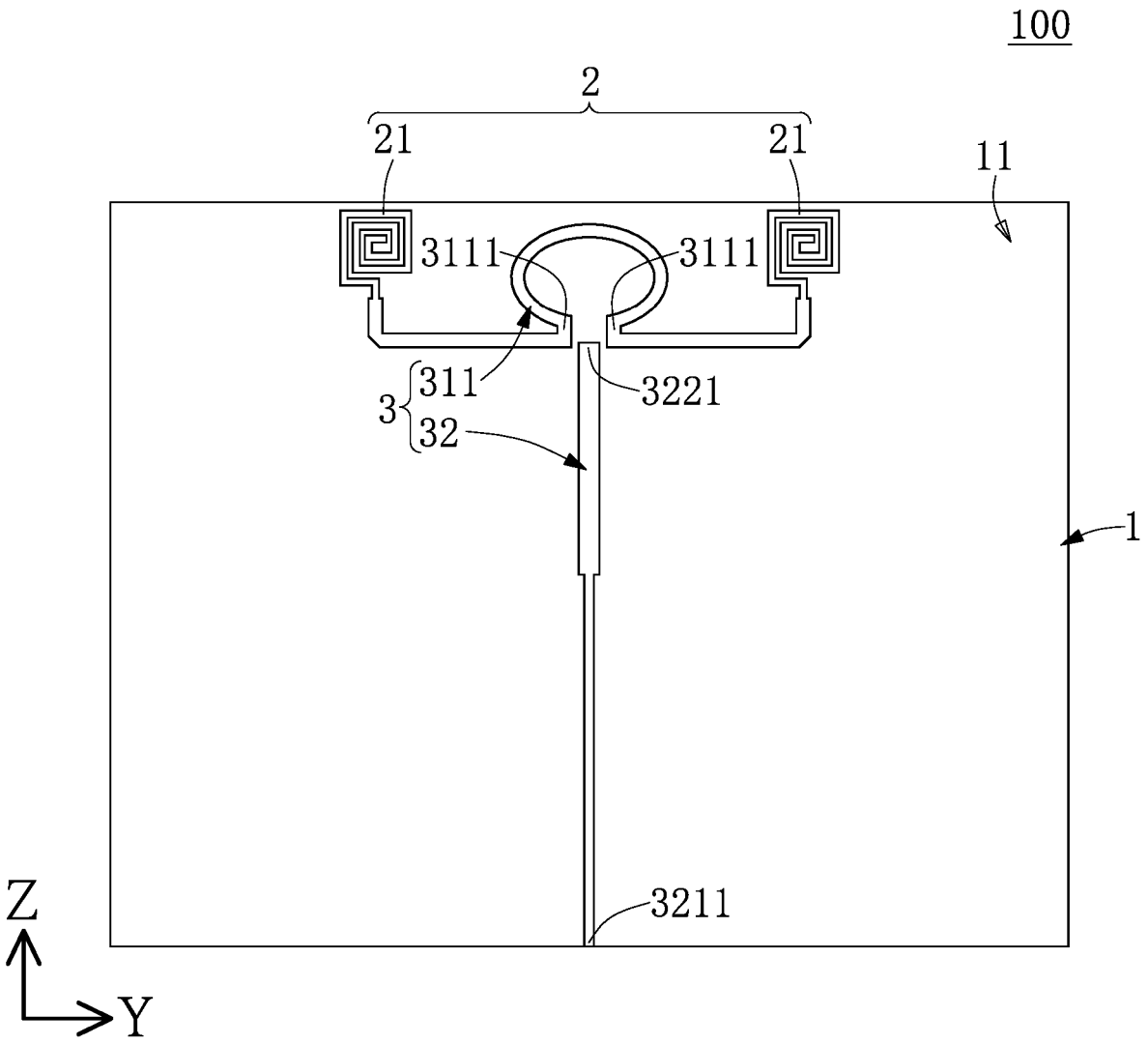
FIG. 13 is a planar view of FIG. 12 with a phase switching unit omitted.

As shown in FIG. 12 and FIG. 13, the present embodiment provides a phased array antenna structure 100 operated in a frequency band that has a center frequency corresponding to a wavelength (i.e., the center frequency is a reciprocal of the wavelength). The phased array antenna structure 100 includes a carrier 1, a radiative layer 2 and a circuit layer 3 both disposed on the carrier 1, and N number of phase switch 4 mounted on the carrier 1 and corresponding in position to the circuit layer 3. The carrier 1 of the present embodiment is similar to that of the first embodiment, so that the description of the carrier 1 in the present embodiment will be omitted for the sake of brevity.

The radiative layer 2 includes two radiating portions 21, and the two radiating portions 21 in the present embodiment have the same shape (e.g., a portion of each of the two radiating portions 21 is in a spiral shape) and are formed on the first surface 11 of the carrier 1. The circuit layer 3 is formed on the first surface 11 of the carrier 1. The circuit layer 3 includes a phased antenna 311 connected to the two radiating portions 21 and a transmission circuit 32 arranged adjacent to the phased antenna 311.

Specifically, the phased antenna 311 includes two end portions 3111 respectively connected to the two radiating portions 21. A length of the phased antenna 311 can be multiples of ¼ of the wavelength, and the length of the phased antenna 311 in the present embodiment is ¼ of the wavelength, but the present disclosure is not limited thereto. Moreover, the phased antenna 311 in the present embodiment is arranged between the two radiating portions 21. In other embodiments of the present disclosure, the phased antenna 311 can be arranged at the left side or the right side of the transmission circuit 32.

The transmission circuit 32 in the present embodiment is in a substantial straight shape, and has a feeding end 3211 and an externally connecting end 3221 opposite to the feeding end 3211. The feeding end 3211 is disposed on (or flush with) an edge of the carrier 1. The feeding circuit 321 extends from the feeding end 3211 to the connecting end 3212 in a direction toward the phased antenna 311. The externally connecting end 3221 is arranged adjacent to the phased antenna 311. In other words, the externally connecting end 3221 is spaced apart from the phased antenna 311. It should be noted that the phased antenna 311 and the radiative layer 2 in the present embodiment are coplanar and are integrally formed as a one-piece structure, and the phased array antenna structure 100 can be in a mirror symmetry with respect to the transmission circuit 32 for being easily manufactured, but the present disclosure is not limited thereto.

Figure 14:
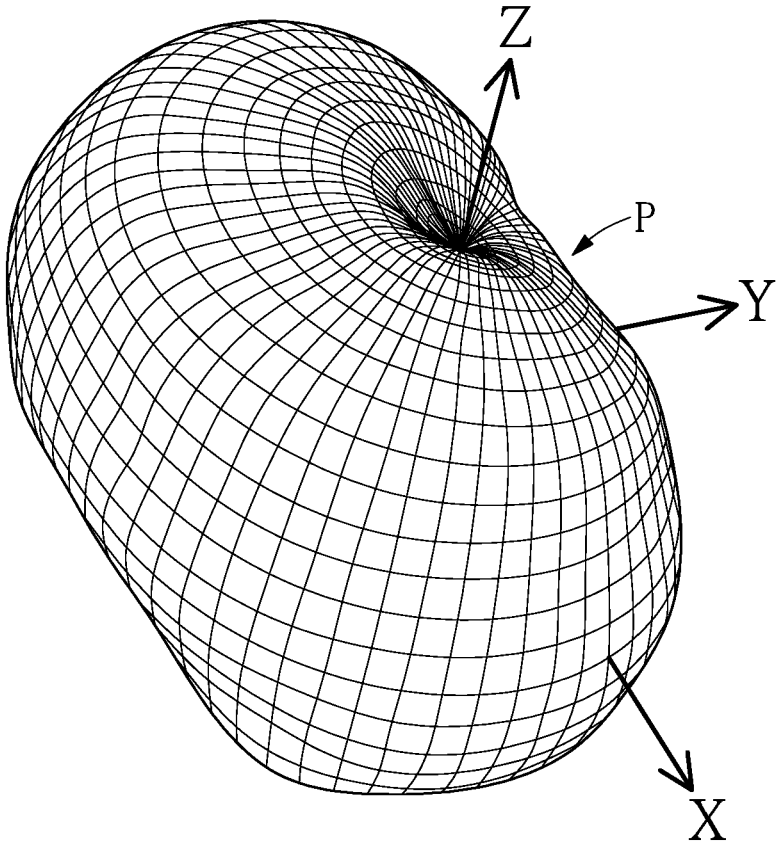
FIG. 14 is an antenna pattern view showing a first operation mode of the phased array antenna structure according to the second embodiment of the present disclosure.
Figure 15:
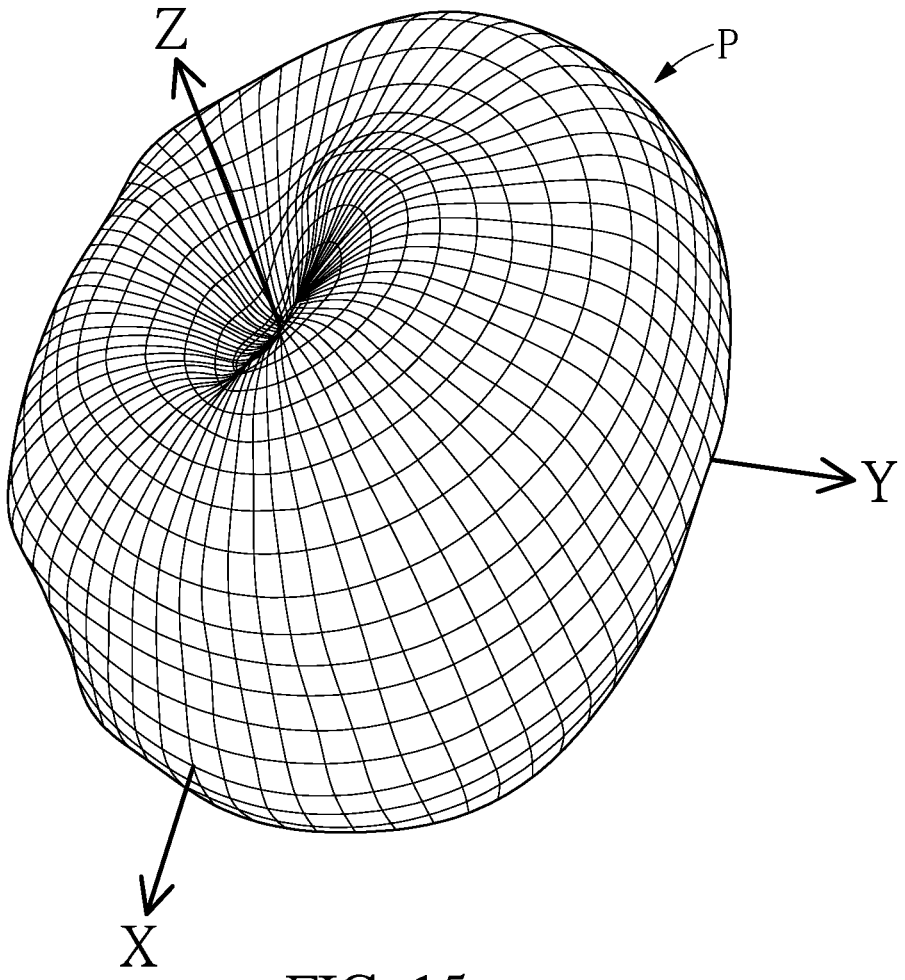
FIG. 15 is an antenna pattern view showing a second operation mode of the phased array antenna structure according to the second embodiment of the present disclosure.

The phase switch 4 is directly or indirectly connected to the externally connecting end 3221 of the transmission circuit 32, and the phase switch 4 is configured to selectively connect only one of the two end portions 3111 of the phased antenna 311, so that the phased array antenna structure 100 can be used to generate two different antenna patterns P (shown in FIG. 14 and FIG. 15). Specifically, as shown in FIG. 14 and FIG. 15, the phased antenna 311 and one of the two radiating portions 21 are configured to jointly generate a first antenna pattern P, the phased antenna 311 and the other one of the two radiating portions 21 are configured to jointly generate a second antenna pattern P, a phase difference between the first antenna pattern P and the second pattern P is 90 degrees.

In conclusion, the phased array antenna structure in the present disclosure can effectively use the phase switching units (or the phase switch) by the structural design and the cooperation of the radiative layer and the circuit layer, so that phased array antenna structure of the present disclosure can be formed without the phase shifter that is at least ten times more expensive than the phase switches.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A phased array antenna structure, comprising:

a carrier;

a radiative layer including N number of radiating portions disposed on the carrier, wherein N is a positive integer greater than one;

a circuit layer disposed on the carrier and including:

N number of phased antenna units respectively corresponding in position to the N numbers of the radiating portions, wherein each of the phased antenna units includes a plurality of phased antennas spaced apart from each other and having different lengths; and a transmission circuit including a feeding end and N number of externally connecting ends, wherein the N number of the externally connecting ends are respectively arranged adjacent to the N number of the phased antenna units; and N number of phase switching units respectively corresponding in position to the N number of the phased antenna units, wherein the N number of phase switching units are respectively connected to the N number of the externally connecting ends of the transmission circuit, and are respectively connected to the N number of radiating portions, wherein in each of the phased antenna units and the corresponding phase switching unit, the phase switching unit is configured to selectively connect with only one of the phased antennas, so that the phased array antenna structure is able to generate at least 2N number of antenna patterns, and wherein the transmission circuit includes:

a feeding circuit having the feeding end and a connecting end opposite to the feeding end, wherein the feeding end is disposed on an edge of the carrier; and a branch circuit having the N number of the externally connecting ends, wherein the connecting end of the feeding circuit is connected to the branch circuit, and a plurality of paths respectively defined from the N number of the externally connecting ends to the connecting end have the same distance.

2. The phased array antenna structure according to claim 1, wherein the N number of the externally connecting ends define a plurality of cross lines each connecting two of the N number of the externally connecting ends, and the connecting end is located at a point of intersection of the cross lines.

3. The phased array antenna structure according to claim 1, wherein N is four, two of the phased antenna units adjacent to the feeding end and the other two of the phased antenna units are in a 2-fold rotational symmetry with respect to the connecting end.

4. The phased array antenna structure according to claim 1, for being operated in a frequency band that has a center frequency corresponding to a wavelength, wherein the different lengths of the phased antennas of each of the phased antenna units are multiples of ¼ of the wavelength.

5. The phased array antenna structure according to claim 1, wherein in each of the phased antenna units, at least one of the phased antennas has a U-shaped portion.

6. A phased array antenna structure, comprising:

a carrier;

a radiative layer including N number of radiating portions disposed on the carrier, wherein N is a positive integer greater than one;

a circuit layer disposed on the carrier and including:

N number of phased antenna units respectively corresponding in position to the N numbers of the radiating portions, wherein each of the phased antenna units includes a plurality of phased antennas spaced apart from each other and having different lengths; and a transmission circuit including a feeding end and N number of externally connecting ends, wherein the N number of the externally connecting ends are respectively arranged adjacent to the N number of the phased antenna units; and N number of phase switching units respectively corresponding in position to the N number of the phased antenna units, wherein the N number of phase switching units are respectively connected to the N number of the externally connecting ends of the transmission circuit, and are respectively connected to the N number of radiating portions, wherein in each of the phased antenna units and the corresponding phase switching unit, the phase switching unit is configured to selectively connect with only one of the phased antennas, so that the phased array antenna structure is able to generate at least 2N number of antenna patterns;

wherein the carrier is a flat board and includes a first surface and a second surface opposite to the first surface, the radiative layer is disposed on the first surface, and the circuit layer and the N number of the phase switching units are disposed on the second surface, and wherein in each of the phased antenna units and the corresponding radiating portion, a projected region defined by orthogonally projecting the radiating portion onto the second surface covers at least part of the phased antenna unit.

* * * * *